US008844973B2

(12) United States Patent
Franko, Sr.

(10) Patent No.: US 8,844,973 B2
(45) Date of Patent: Sep. 30, 2014

(54) EXPANDED CONTENT LABEL HAVING A STRATEGICALLY LOCATED RELEASE-RESEAL SYSTEM

(75) Inventor: Joseph D. Franko, Sr., Ham Lake, MN (US)

(73) Assignee: Quality Assured Enterprises, Inc., Hopkins, MN (US)

( * ) Notice: Subject to any disclaimer, the term of this patent is extended or adjusted under 35 U.S.C. 154(b) by 974 days.

(21) Appl. No.: 11/858,718

(22) Filed: Sep. 20, 2007

(65) Prior Publication Data

US 2008/0073902 A1 Mar. 27, 2008

Related U.S. Application Data

(60) Provisional application No. 60/846,557, filed on Sep. 21, 2006.

(51) Int. Cl.
*B42D 15/00* (2006.01)
*G09F 3/00* (2006.01)

(52) U.S. Cl.
CPC ..... *G09F 3/0289* (2013.01)
USPC ..... 283/81; 283/94; 283/98; 283/101; 283/106

(58) Field of Classification Search
USPC ..... 156/90; 283/81, 94, 98, 101, 106; 428/40.1, 41.7, 41.8, 42.1, 42.2, 42.3
IPC ..... B32B 9/00; B42D 15/00
See application file for complete search history.

(56) References Cited

U.S. PATENT DOCUMENTS

| | | | | |
|---|---|---|---|---|
| 5,149,587 | A | 9/1992 | Hill et al. | |
| 5,264,265 | A | 11/1993 | Kaufmann | |
| 5,904,973 | A | 5/1999 | Coward et al. | |
| 2004/0207193 | A1 * | 10/2004 | Franko, Sr. | 283/81 |

* cited by examiner

*Primary Examiner* — Shelley Self
*Assistant Examiner* — Justin V Lewis
(74) *Attorney, Agent, or Firm* — Walter K. Roloff

(57) ABSTRACT

An expanded content label is disclosed which opens from a strategically located release-reseal system located at other than an edge of the label.

16 Claims, 5 Drawing Sheets

EXPANDED CONTENT LABEL HAVING A STRATEGICALLY LOCATED RELEASE-RESEAL SYSTEM

CROSS-REFERENCED TO RELATED APPLICATIONS

This application claims priority based on Provisional Application No. 60/846,557, filed Sep. 21, 2006.

STATEMENT REGARDING FEDERALLY SPONSORED RESEARCH OR DEVELOPMENT

Not applicable

BACKGROUND OF THE INVENTION

I. Field of the Invention

The present invention relates generally to labels. The invention relates specifically to an expanded content label having a strategically located release-reseal system for containers having dimensions that may be difficult to label.

II. Related Art

In the packaging and printing arts and, in particular in the commercial printed label art for labeling and decorating consumer products, there exists a continual demand for labels and decorations which not only appeal to consumers, but also bear ever increasing amounts of printed information. For example, labels for identification of consumer health care and pharmaceutical products are often required by governmental regulations to describe in painstaking detail their compositions and ingredients. As new food and drug laws are passed, regulations require the inclusion of increasing amounts of label information. Manufacturers of consumer products and their packaging vendors have devised various schemes for inclusion of such extensive information. Among these are simply printing the information in small type on product container boxes or cartons, or including information insert sheets within the boxes or cartons. Obvious drawbacks to these schemes include increased packaging costs associated with boxes and cartons, and the fact that boxes, cartons, and insert sheets are often promptly discarded by a consumer and therefore, do not remain with their respective products during product lifetimes.

To provide increased printed information on labels, various forms of so-called "expanded content" labels have been proposed. As used here throughout, "expanded content labels" or ECLs" are intended to include "extended text" labels, "booklet" type labels, and multi-layered or multi-ply labels, all describing labels having an appearance or effect of including multiple plies.

The expanded content type of label has gained wide popularity, wherein a base ply is joined to a top ply via an adhesive coupling or "hinge" between the two plies. Such labels normally contain two or more material plies hinged together using a pressure-sensitive adhesive. The hinge is formed along one margin. A pressure-sensitive release-reseal system is used along the opposite margin. For example, Kaufmann in U.S. Pat. No. 5,264,265; Hill et al in U.S. Pat. No. 5,149,587; and Coward et al in U.S. Pat. No. 5,904,973 show label constructions of this type.

The application of known ECLs to some containers, however, has been problematic. For instance, a container such as a deodorant barrel having an elliptical cross-section may have, largely depending on the overall size of the container, a relatively short or "sharp" radius of curvature near the foci thereof. In a conventional ECL, the release-reseal system is often located near one of the foci and may inadvertently become opened due to an absence of a relatively flat container surface underlying the release-reseal system of the label. Such containers, then, have been difficult to successfully label because of a tendency for extended content labels to lift off at the hinge or spontaneously "pop open" or be simply too easy to open on such containers.

Therefore, it would be decidedly advantageous to provide an ECL that remained closed on a container of relatively small or "sharp" radii of curvature, until it was intentionally opened by a user. It would also be advantageous for such an ECL to be capable of being efficiently produced using an in-line web press manufacturing method.

SUMMARY OF THE INVENTION

By means of the present invention, there is provided an expanded content label having a strategically located release-reseal system for opening the label that remains closed on a container having relatively short or "sharp" radii of curvature, until it is intentionally opened by a user.

The present invention further provides an expanded content label having a strategically located release-reseal system that may be efficiently produced using an in-line web press manufacturing method.

In accordance with the present invention, in a first embodiment, an expanded content label having a strategically located release-reseal system includes top and base plies hinged at one edge and having a release-reseal system located somewhere along the length of the label hut before an opposite edge of the base ply. To enable opening of the label at the release-reseal location, the top ply is severed at the location of the release-reseal system such that the top ply is enabled to open at a location other than at the edge of the base ply. The remainder of the top ply may be adhered to the base ply in the manner of the hinge with a strong bond intended to last for the life of the label. This portion of the label, as with the hinge portion located at the opposite edge of the label may encounter and be adhered to a short or sharp radius of curvature of an elliptical shaped container, for example, as illustrated in FIG. 2*b*. This places the openable release-reseal system in the vicinity of a longer radius of curvature which is closer to being flat and wherein it is much more stable.

In an alternative embodiment, the portion of the top ply beyond the location where the top ply is severed, may conveniently be removed leaving only the base ply for the remainder of the label length. The underside of the single remaining base ply can easily be adhered to the container at the point of application around the short or sharp radius of curvature where it will remain permanently attached.

The top ply is preferably severed using a die cutting technique in accordance with in-line web pass manufacturing techniques as are well known.

BRIEF DESCRIPTION OF THE DRAWINGS

In the drawings wherein like numerals are utilized to designate like parts throughout the same.

DETAILED DESCRIPTION

Figure 1:
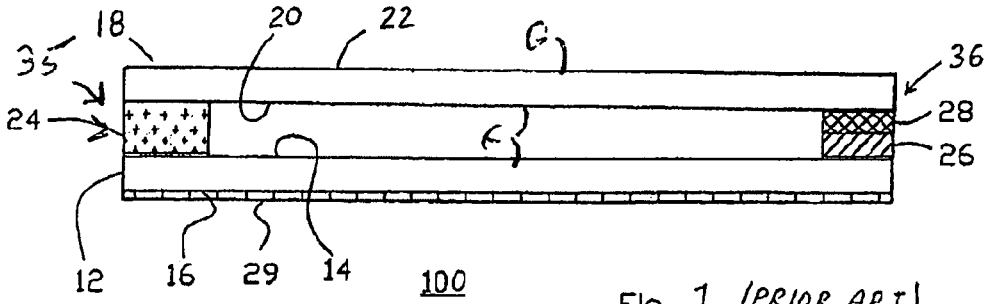
Fig. 1 (PRIOR ART)
FIG. 1 is a schematic side view of a conventional expanded content label of the prior art.

The detailed description contained herein in conjunction with the drawing figures presented is intended by way of example with respect to the inventive concept and is not intended to be limiting in any way. With this in mind, FIG. 1 shows a conventional expanded content label 100 of a particular construction providing a so-called "three-page" booklet function. The label is typically carried on a pressure-sensitive adhesive liner 29 as is known in the art, for ease in dispensing individual labels onto containers to be labeled. Label 100 includes a hinge portion and a release-reseal portion, as will be further described. Label 100 is constructed from a top ply 18 of material and a base ply 12 of material (which may be identical label stock materials). Top ply 18 has an upper side 22 and an under side 20, and similarly base ply 12 has an upper side 14 and an under side 16. The plies together define a hinge 35 at one edge of label 100, and a release-reseal system 36 at an opposite edge. Label 100 may, of course, have any desired graphics G on any surfaces of the top and base plies.

It is to be understood that as used herein throughout, and in the drawings, the term "graphics" includes, but is not limited to: various printing media; adhesives; hot melts; varnishes; inks; release coatings; hot and cold foil stampings; and any suitable additions to, or deletions from, a label ply. Plies 12 and 18 each are preferably web-like materials, being compatible for use in an in-line web press manufacturing method for labels 100-100*b* (and also 200-200*a*, as will be later described). As used herein throughout, "web-like materials" denotes any suitable material or combination hereof, including but not limited to paper, film, polypropylene, polyethylene, polyester, polyvinylchloride, polystyrene, foil, and ethylene vinyl acetate, whether clear, opaque, or metallized. These web-like materials for plies 12 and 18 (and ply 30, as will be described relative to FIGS. 1*a*-*b*) may be made of any suitable materials that meet physical and chemical compatibility requirements, along with desired aesthetic attributes and cost considerations of a particular label.

Figure 2:
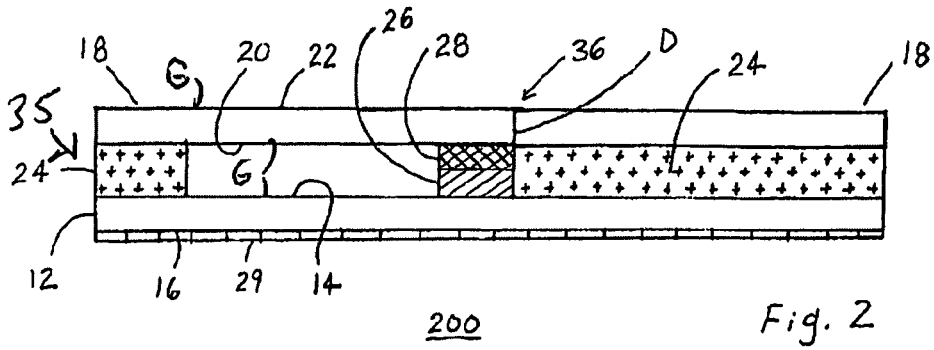
FIG. 2 is a schematic side view of the expanded content label having a strategically located release-reseal system of the present invention.
Figure 2A:
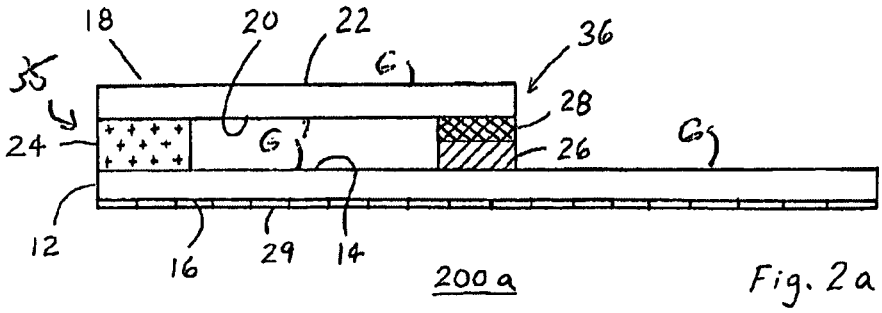
FIG. 2*a* is a schematic side view of an alternative embodiment of the expanded content label having a strategically located release-reseal system of the present invention.

As shown in FIGS. 1-2*a*, the plies are capable of receiving printed graphic text and images thereon, during, for example, manufacture of the labels in an in-line web press manufacturing method (not illustrated). It is to be understood that where necessary, the sides or surfaces of the plies to be printed may receive one or more depositions of material to "adjust" receptiveness to printing materials.

Thus, an array of papers, plastics, and related materials may variously be employed for the plies, the surfaces of which may be adjusted as needed by those skilled in the art.

With continued reference to FIG. 1, top ply 18 is joined to base ply 12 along a strip that is normally the aforementioned hinge portion using a first adhesive material 24 to form a binding or hinge between side 14 of base ply 12 and side 20 of top ply 18. Thus, the first adhesive material 24 is designed to create a strong bond between base ply 12 and top ply 18 that is intended to last for the life of the label. In this manner, top ply 18 resists unintentional peeling away and removal from label 100. The first adhesive may preferably be one which is not pressure sensitive and that advantageously cures to a solid or dry (non-tacky) state as explained below.

Figure 1A:
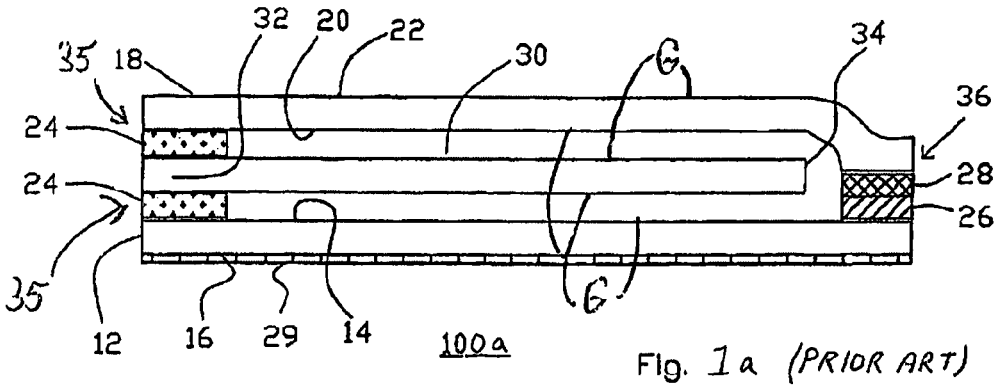
Fig. 1a (PRIOR ART)
FIG. 1*a* is a schematic side view of another conventional expanded content label of the prior art.
Figure 1B:
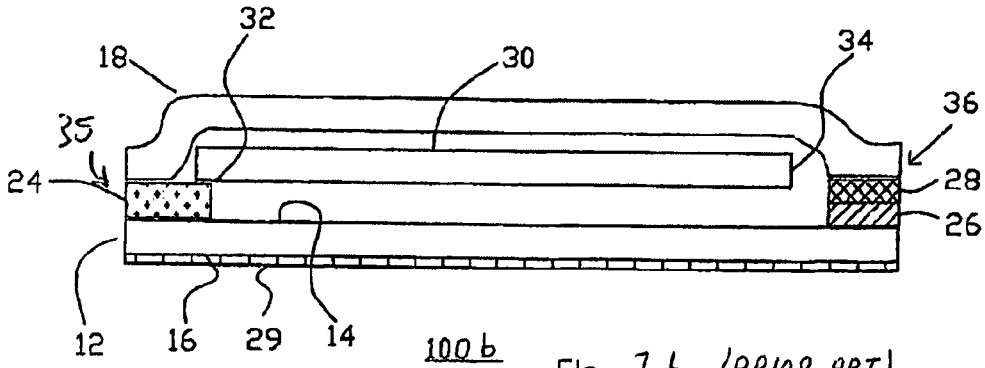
Fig. 1b (PRIOR ART)
FIG. 1*b* is a schematic side view of another conventional expanded content label of the prior art.

With continued reference to FIGS. 1-1*b* relative to the release-reseal portion 36, a portion of upper side 14 of base ply 12 is provided with a release coating 26 which may selectively cover almost entirely an area of upper side 14 exclusive of regions corresponding to first adhesive material 24 in "zone coat" fashion, or some considerably lesser amount as shown in the drawings. Release coating 26 is typically a varnish, lacquer, ink, or other coating that acts to inhibit or reduce adhesion. A second adhesive material 28 that is preferably of the so-called pressure sensitive or persistently tacky (sticky to the touch) type (also explained below) is provided in a region of under side 20 of top ply 18. This material 28, in conjunction with, and as substantially aligned with, release coating 26 as shown in the figures, enables release and resealing of top ply 18 as is well known. In combination, second adhesive material 28 and release coating 26 may be characterized as a "release-reseal system".

Those skilled in the art understand that adhesive materials 24 and 28 may be selectively in forms of continuous, discontinuous, or intermittent patterns. In this regard, it is only necessary (i) that adhesive material 24 (and the hinge in general) provides sufficient strength to securely bond plies 12 and 18 together, (ii) that adhesive material 28 (and the release-reseal system in general) provides sufficient tack to prevent unaided or unintentional opening of label 100, and (iii) that the pattern of adhesive material 28 be substantially aligned with release coating 26 when plies 12 and 18 are sealed.

Turning now to FIGS. 1*a* and 1*b*, alternate constructions of the aforedescribed prior art label are depicted which each provide a so-called "five-page" booklet function. Therein, at least one middle or intermediate ply 30 having an under side and an upper side is provided between base ply 12 and top ply 18. Intermediate ply 30 is also hinged by first adhesive material 24 along one edge at 32, and has free sides and a free end 34. In label 100*a*, intermediate ply 30 is hinged by first adhesive material 24 along one edge at 32 to base ply 12, and top ply 18 is consecutively hinged by a separate deposition of first adhesive material 24 to intermediate ply 30, in layered or "pancake-syrup-pancake-syrup" fashion. However, in label 100*b*, this arrangement is modified somewhat, in that intermediate ply 30 may be characterized as having a "shared hinge" with top ply 18 as shown in the drawing.

In either case, end 34 of intermediate ply 30 terminates before reaching second adhesive material 28 of the respective release-reseal systems so that it is captured within label 100*a* or 100*b* when top ply 18 is held closed by the release-reseal system. As can be seen in FIGS. 1*a* and 1*b*, the release-reseal system may be preferably limited to a vicinity of the edge of the label that is opposite the hinge edge. As with label 100, the release-reseal systems of labels 100*a*-*b* require only that release coating 26 be substantially aligned with adhesive material 28 on an opposing surface of the adjacent ply.

FIGS. 2 and 2*a* depict two alternative embodiments of the expanded content label having a strategically located release-reseal system in accordance with the present invention. Labels 200 and 200*a* also provide a so-called "three-page" booklet function. Label 200 includes a top ply 18 and a base ply 12 (which may be identical or different materials). Top ply 18 has an upper side 22 and an under side 20, and similarly base ply 12 has an upper side 14 and an under side 16. The plies together define a hinge 35 at one edge of label 200, and a release-reseal system 36 at an opposite edge adjacent to a die cut D which is made through top ply 18 down to approximately upper side 14 of base ply 12. Label 200 may have any desired graphics G on any surfaces of the top and base plies.

With continued reference to FIGS. 2-2*a*, top ply 18 is joined to base ply 12 along a strip that is normally the aforementioned hinge portion using a first adhesive material 24 to form a binding or hinge between side 14 of base ply 12 and side 20 of top ply 18. Thus, the first adhesive material 24 is designed to create a strong bond between base ply 12 and top ply 18 that is intended to last for the life of the label. In this manner, top ply 18 resists unintentional peeling away and removal from labels 200-200*a*. The first adhesive may preferably be one which is not pressure sensitive and that advantageously cures to a solid or dry (non-tacky) state, again as explained below. It is to be noted particularly with respect to the hinge that a consumer may, inadvertently, attempt to peel back or open an expanded content label at an incorrect location. The preferred hinge of the present invention is one that is strong enough to discourage and inhibit an inadvertent splitting apart and removal from each other of the label plies.

In labels 200-200*a* of FIGS. 2-2*a* a portion of upper side 14 of base ply 12 is provided with a release coating 26 (having properties as aforedescribed) which may selectively cover almost entirely an area of upper side 14 exclusive of regions corresponding to first adhesive material 24 in "zone coat" fashion, or some considerably lesser amount as shown in the drawings. Adhesive materials 24 and 28 of labels 200-200*a* may be applied in different patterns including continuous, discontinuous, or intermittent patterns.

It is to be recognized and understood that unlike prior ECLs which incorporate hinge and release-reseal portions at edges of the labels, the novel constructions of the label of the present invention, as exemplified in FIGS. 2 and 2*a*, in fact teach away from such prior art edge placements of the release-reseal system. In the novel constructions of the present invention, the release-reseal system is located at some intermediate point other than an edge of the label.

Figure 1C:
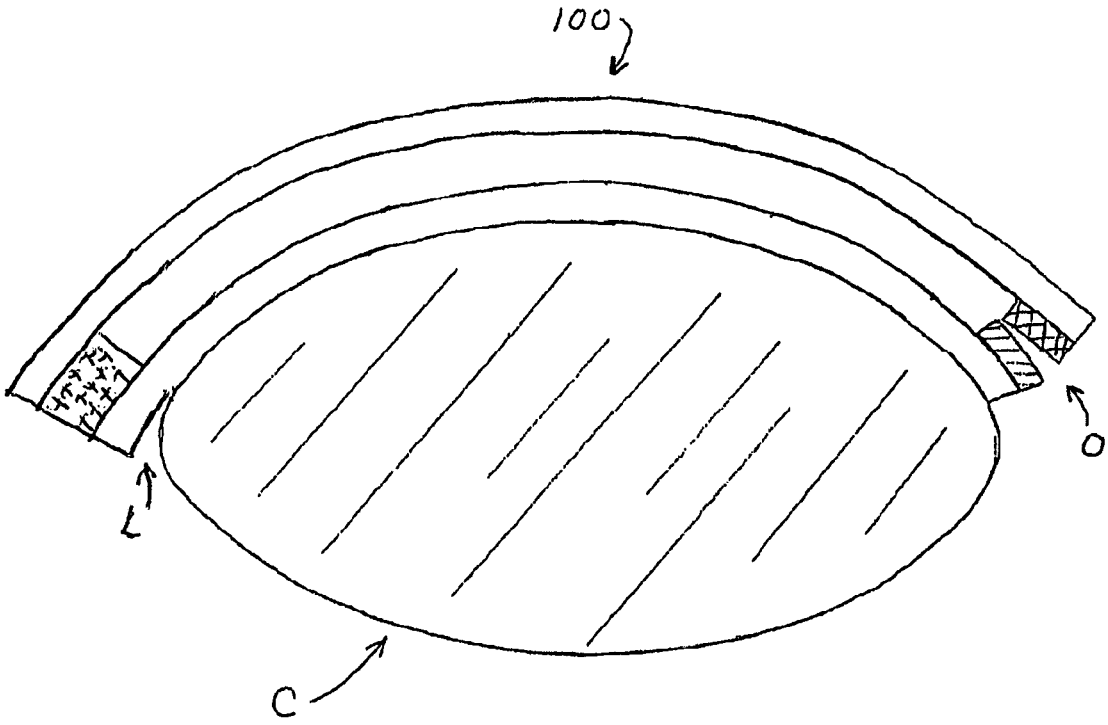
FIG. 1*c* is a schematic side view of the prior art label of FIG. 1*a*, affixed to a container C and exhibiting an undesirable tendency to lift off and "pop open".
Figure 2B:
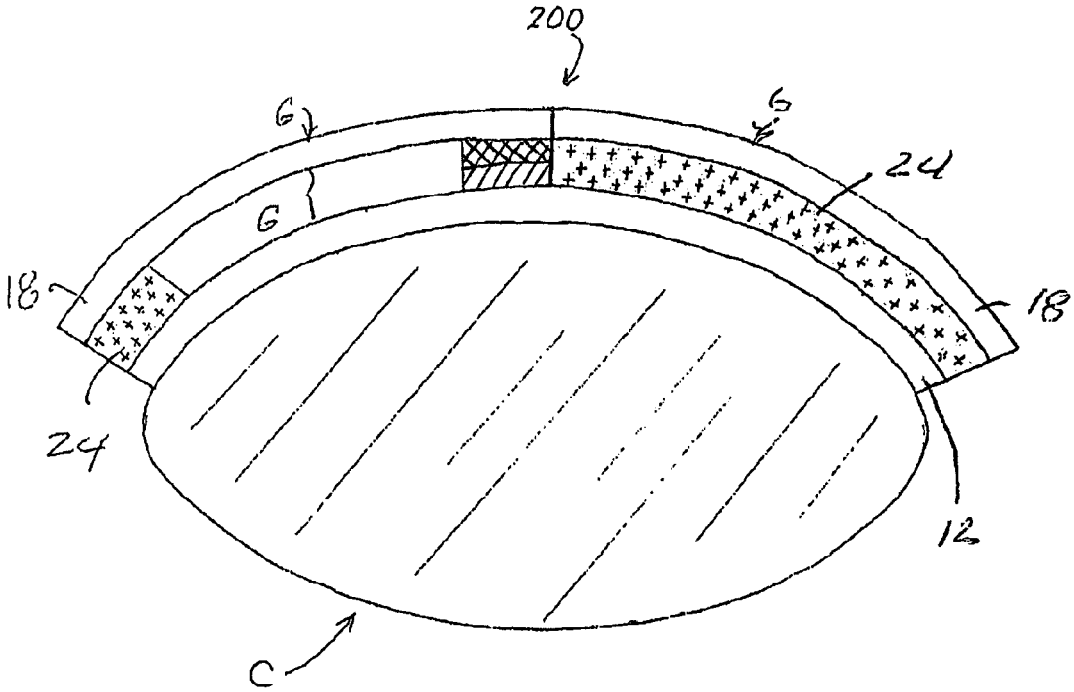
FIGS. 2*b* and 2*c* are schematic side views of the labels of FIGS. 2 and 2*a* of the present invention, affixed to a container C without "popping open".
Figure 2C:
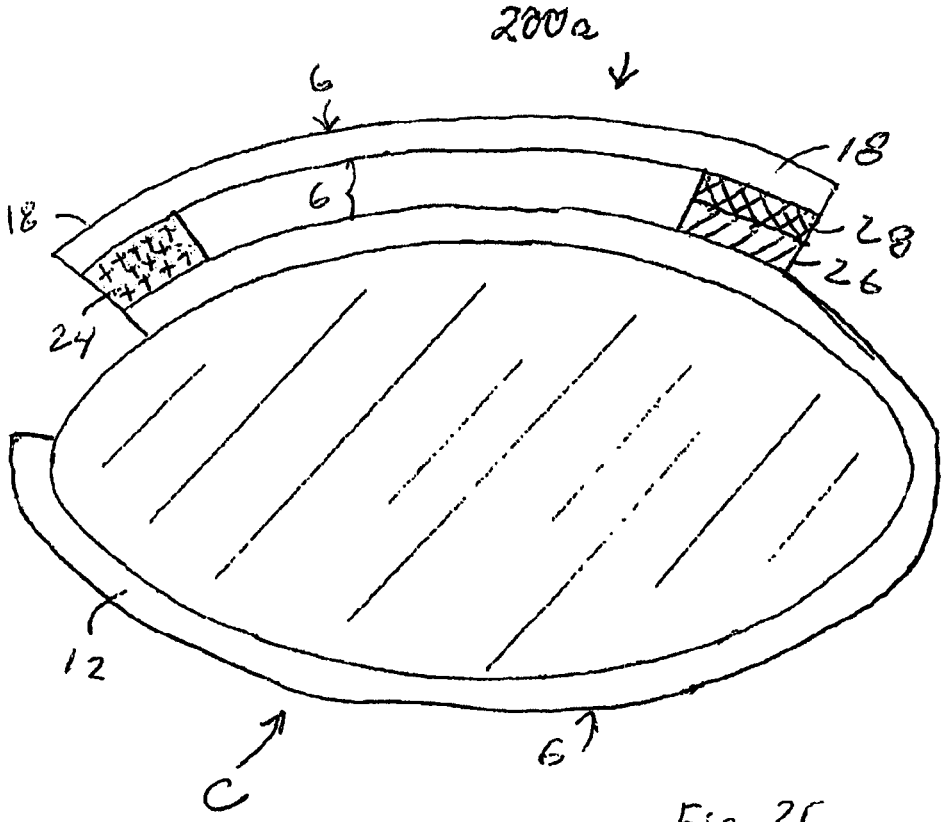

In such a configuration, it will be understood, the aforementioned undesirable tendency of the label to "pop open" or to "lift off" (as depicted at L and O, respectively, in FIG. 1*c*) is minimized when a label in accordance with the invention is affixed to a container C having an elliptical cross-section. This is because only (i) an effectively "laminated" construction of top ply 18 to base ply 12 (as in FIG. 2) or (ii) base ply 12 itself (as in FIG. 2*a*), occurs at a curve of short or sharp radius, possibly the rightmost label edge. Thus, a label in accordance with the embodiment 200 of the invention shown in FIG. 2 is affixed to a container C having an elliptical cross-section (as depicted in FIG. 2*b*, relative to label 200) the release-reseal systems 36 of exemplary labels 200 and 200*a* are generally located over relatively flat surfaces rather than over those corresponding to the "sharp" radii of curvature. In other words, only the laminated plies 12 and 18 of label 200, or the single ply 12 of label 200*a*, are positioned over the "sharp" curved portions of the containers. Likewise, FIG. 2*c* depicts the embodiment 200*a* shown in FIG. 2*a* applied to a similar container C using a wrap application as would typically be used for such labels.

As understood by those skilled in the art, the constructions of labels 200 and 200*a* differ only in the absence of adhesive 24 beyond being used for hinge 35 and top ply 18 in label 200*a* as shown; this may be achieved in label 200*a* by selective die cut D and stripping away a waste matrix containing the portion of top ply 18 to be removed, or by any other suitable technique to arrive at the construction of label 200*a*. In either label 200 or 200*a*, it is to be understood that die cut D permits a user to access a release-reseal systems 36 at a selected point in the labels other than at their distal edges.

Those skilled in the art will recognize from the foregoing that several distinct classes or types of adhesive materials may be employed in ECLs, namely, those that are characterized by pressure sensitivity and those that are not. It is to be particularly appreciated that, as used herein, an adhesive that is not pressure sensitive is one that is solid or dry and tack-free or not sticky to the touch in its cured or final adhesive state, in bonding plies together. Such materials may be called non-pressure sensitive or dry-curing or solid-curing in this specification. Such materials lose any stickiness or tack when cured. The class of dry-curing or solid-curing adhesives may be further characterized as including several types of adhesives having the required characteristics such as (i) any glues, (ii) non-pressure-sensitive adhesive materials including but not limited to heat seal adhesives, (iii) multiple part epoxies, (iv) chemical welding or bonding materials, and (v) mechanical fastening means, that all become dry or non-tacky after bonding objects together.

In this regard, a universally accepted reference text, *The Concise Encyclopedia of Polymer Science and Engineering* (New York, 1990) states at page 35, with respect to dry-curing adhesive bonds: "Eventually, the adhesive must undergo a phase change, i.e., by cooling, solvent evaporation or reaction, to a solid in order for the [bonded] joint to acquire the necessary strength to resist shearing forces." The foregoing refers to a phase change from liquid to a dry, solid state. Adhesive materials used in hinge portions of expanded content labels, for example, may preferably be selected from dry-curing adhesives including hot melt adhesives, solvent-based adhesives, water-based adhesives, and UV (ultraviolet)-curable and EB (electron beam)-curable adhesives. Examples of preferred adhesive materials include UV-curable adhesives. UV-curable materials are well known and exemplified by a class of such materials available from PAD-CURE Corporation of Fairfield, N.J., including PAD-CURE 10PSLVA,B, for example.

The class of adhesives known as "pressure-sensitive" adhesives is contrasted with dry-curing adhesives in the next sentence of the aforecited reference text that reads: "A notable exception is the category of pressure-sensitive adhesives, where no phase change occurs." This also describes the term "pressure-sensitive" as used herein. Such pressure-sensitive materials remain tacky or sticky to the touch. Adhesion may be modified (reduced) by providing deadening or detackifying overlayers, but the material does not solidify and remains, in effect, a viscous liquid to some degree. Under some conditions, pressure-sensitive adhesives can ooze from bonds made with them long after assembly. Generally, bonds between plies made using pressure-sensitive adhesives can be pulled apart without damage to the plies, whereas those made using dry-curing or tack-free-curing adhesives cannot. This is particularly true with respect to multiple-ply expanded content labels. It is also to be noted that label plies of an exclusively pressure-sensitive label construction may yield to moving and shifting forces due to the remaining ability to flow (e.g. ooze) of the pressure-sensitive adhesive material.

Within a class, preference of one such adhesive over another will particularly depend upon a drying or curing system of a given web press, along with materials composition and compatibility considerations.

It is also to be noted that although depicted in one configuration in the figures, the materials and coatings of ECLs may typically be applied to corresponding plies in any order, either separately, as one on each ply, or together as a combination on one ply. Thus, for example in FIGS. 1-2*a*, adhesive material 24 may be applied to upper side 14 of base ply 12 and/or to under side 20 of top ply 18. Adhesive material 28 may also be applied to upper side 14 of base ply 12 or to under side 20 of top ply 18 (as shown), while release coating 26 may be applied, respectively, to under side 20 of top ply 18 or to upper side 14 of base ply 12 (as shown). Second adhesive material 28 may also be applied in any varying intermittent patterns about all or only a portion of the aforementioned areas of the labels if desired.

It is to be noted that the labels of the present invention may be created entirely in-line, in a roll-to-roll process, thereby assuring quality and low cost. Such in-line processes include any suitable multi-unit in-line presses such as narrow- or wide-web platform presses, whether flexographic, letterpress, gravure, screen, or offset. Such presses are commercially available from, for example, Comco International of Milford, Ohio, and Mark Andy Inc. of St. Louis, Mo.

Although a dry or solid-curing, or tack-free-curing adhesive has been disclosed herein as being preferred for adhesive material 24, it will be appreciated that a pressure-sensitive adhesive of sufficient adhering strength could, of course, be readily substituted and such may be used in certain embodiments.

Furthermore, it is to be understood that various materials may be substituted in construction of the labels of the present invention. In the preferred and exemplary embodiment herein, a paper base ply 12 and film top ply 18 may be utilized. A film top ply is preferred for its flexibility relative to curved or irregular container surfaces to be labeled, while a paper base ply is well suited for adhesion to a container by way of a conventional glue. However, paper could, of course, be substituted for film, and vice-versa, depending upon label cost parameters and other particular desires of a label customer. The adhesive for applying the label to a container is typically applied at the time the label is attached. In the case of a film base ply, it is known to those skilled in the art that conventional glues used in glue labeling equipment do not adhere well thereto. In response to this problem, Krones AG of Neutraubling, Germany and Applied Extrusion Technologies, Inc. (AFT Films) of Terre Haute, Ind., USA, have developed a technique for glue labeling equipment utilizing a liquid adhesive (analogous to a conventional glue) that is UV- or EP-cured or activated just prior to application thereby rendering a satisfactory pressure-sensitive type adhesive for attachment of the film to a non-porous container.

It will also be appreciated that as used here throughout and in the drawings, the terms "printing", "graphics" and "coatings" include, but are not limited to, various printing media, adhesives, hot melts, varnishes, inks, release coatings, etc.

The invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself. For example, it will be appreciated that any of the aforedescribed graphics, coatings, materials, hinges, and release-reseal systems may be selectively provided in any suitable combination on labels constructed according to the present invention, for a particular desired use. Thus, in FIGS. 2 and 2*a*, the relative positions of release coating 26 and second adhesive material 28 could be interchanged, as well as the locations of the hinge and release-reseal portions.

It is also to be understood in general that any suitable alternatives may be employed to provide the expanded content label having a strategically located release-reseal system of the present invention.

Lastly, the choice, of course, of compositions, sizes, and strengths of various aforementioned components of the label of the present invention are all a matter of design choice depending upon intended uses thereof. Accordingly, these and other various changes or modifications in form and detail of the present invention may also be made therein, again without departing from the true spirit and scope of the invention [as defined by the appended claims].

The invention claimed is:

1. An expanded content label suitable for use on a container having an area of relatively sharp curvatures comprising:

(a) a base ply having an under side designed to be adhered to a container to be labeled and an upper side and having a first edge and an opposite edge, said edges defining the length thereof;

(b) a top ply having a first edge and an opposite edge, said edges defining the length thereof;

(c) a hinge connecting said first edge of said base ply with said first edge of said top ply; and (d) a release-reseal system connecting said base ply with said top ply at a location intermediate the edges of said base ply and said top ply and wherein said top ply is severed at said intermediate location enabling said expanded content label to open and reseal at said location intermediate said ends of said plies, wherein said top ply, beyond the location where said top ply is severed, is entirely removed from the label leaving only said base ply between (i) the location where said top ply is severed and (ii) said opposite edge.

2. An expanded content label as in claim 1 wherein the top ply is adhered to the base ply along its length beyond said release-reseal system.

3. An expanded content label as in claim 1 wherein said release-reseal system is generally located toward the middle of the label.

4. An expanded content label as in claim 1 wherein said hinge includes a solid-curing adhesive that undergoes a phase change upon curing.

5. An expanded content label as in claim 1 wherein said base ply includes paper and said top ply comprises a film.

6. An expanded content label as in claim 1 wherein both said base ply and said top ply comprise a film.

7. An expanded content label as in claim 1 wherein both said base ply and said top ply comprise paper.

8. An expanded content label as in claim 1 wherein at least one exposable surface contains graphics.

9. An expanded content label suitable for use on a container having an area of relatively sharp curvatures comprising:

(a) a base ply having an under side designed to be adhered to a container to be labeled and an upper side and having a first edge and an opposite edge, said edges defining the length thereof;

(b) a top ply having a first edge and an opposite edge, said edges defining the length thereof;

(c) a hinge connecting said first edge of said base ply with said first edge of said top ply; and (d) a release-reseal system connecting said base ply with said top ply at a location intermediate the edges of said base ply and said top ply and wherein said top ply is severed at said intermediate location enabling said expanded content label to open and reseal at said location intermediate said ends of said plies, wherein said top ply, beyond the location where said top ply is severed, is entirely removed from the label leaving only said base ply between (i) the location where said top ply is severed and (ii) said opposite edge, and wherein said top ply does not include a tear strip; and (e) a pressure-sensitive adhesive material provided on said under side of said base ply.

10. An expanded content label as in claim 9 wherein the top ply is adhered to the base ply along its length beyond said release-reseal system.

11. An expanded content label as in claim 9 wherein said release-reseal system is generally located toward the middle of the label.

12. An expanded content label as in claim 9 wherein said hinge includes a solid-curing adhesive that undergoes a phase change upon curing.

13. An expanded content label as in claim 9 wherein said base ply includes paper and said top ply comprises a film.

14. An expanded content label as in claim 9 wherein both said base ply and said top ply comprise a film.

15. An expanded content label as in claim 9 wherein both said base ply and said top ply comprise paper.

16. An expanded content label as in claim 9 wherein at least one exposable surface contains graphics.

* * * * *